US005464211A

United States Patent [19]

Atkins, Sr.

[11] Patent Number: 5,464,211

[45] Date of Patent: Nov. 7, 1995

[54] GOLF CLUB HEAD

[76] Inventor: Clyde Atkins, Sr., 361 Rowe St., Conneaut, Ohio 44030

[21] Appl. No.: 308,571

[22] Filed: Sep. 19, 1994

[51] Int. Cl.[6] ..... A63B 53/04

[52] U.S. Cl. ..... 273/78; 273/167 H; 273/173

[58] Field of Search ..... 273/167 R, 167 H, 273/173, 172, 171, 169, 78, 167 J, 77 R, 170, 193 R, 194 R, 162 R, 162 F, 194 A

[56] References Cited

U.S. PATENT DOCUMENTS

| | | | |
|---|---|---|---|
| 1,467,435 | 9/1923 | Kinnear | 273/173 |
| 1,567,248 | 12/1925 | Dahlman | 273/173 |
| 1,665,523 | 4/1928 | Boyce | 273/173 |
| 1,673,973 | 6/1928 | Drevitson | 273/173 |
| 1,825,244 | 9/1931 | Nero | 273/170 |
| 2,175,598 | 10/1939 | Fedak | 273/173 |
| 3,567,228 | 3/1971 | Lynn | 273/173 |
| 4,067,572 | 1/1978 | Coleman | 273/167 J |
| 4,432,549 | 2/1984 | Zebelean | 273/172 |
| 4,461,481 | 7/1984 | Kim | 273/167 H |
| 4,535,990 | 8/1985 | Yamada | 273/167 H |
| 4,811,949 | 3/1989 | Kobayashi | 273/167 H |
| 4,944,515 | 7/1990 | Shearer | 273/171 |
| 5,000,454 | 3/1991 | Soda | 273/173 |
| 5,316,298 | 5/1994 | Hutin | 273/173 |

*Primary Examiner*—Sebastiano Passaniti
*Attorney, Agent, or Firm*—Donald A. Bergquist

[57] ABSTRACT

A hollow golf club head for a "metal wood" is disclosed wherein an internally-mounted backing plate gives strength and stability to the striking face of the club. Additionally, in the preferred embodiments, an internal apparatus is present whereby the backing plate is compressively loaded to more rigidly support the striking face of the club, thereby to make it more unyielding upon impact with a golf ball. In further embodiments, weights may be added behind the backing plate in alignment with an axis that is normal to the center of the striking face.

20 Claims, 2 Drawing Sheets

GOLF CLUB HEAD

INTRODUCTION

This invention relates to golf club heads and more particularly to metal heads for clubs known as "woods" (i.e., "metal woods"), including clubs known as "drivers". In particular, this invention applies to such clubs that comprise a hollow, flat-faced bulbous shape formed of a continuous rather thin skin of metal, preferably stainless steel, or of a high-tech plastic or reinforced plastic.

BACKGROUND AND PRIOR ART

Hollow metal heads for golf clubs of the type known as "woods" have become extremely popular within the sport of golf. These are commonly referred to by the term "metal woods", which we shall use herein for convenience. Also for convenience, we shall use this term to include newer high-technology hollow club heads that are gaining favor in some golfing circles, such as so-called "graphite heads", which are actually made from a resinous material reinforced with fibers of carbon or graphite and formed by various means including winding resin-impregnated fibers on a mandril or forming in a mold sheets of resin-impregnated fiber mats, which processes are performed before the resin is fully cured.

Metal woods present numerous options to the golf club manufacturer to provide customized weight and balance for the golfer, whether he be an amateur or a professional. All golfers, to improve accuracy and precision of their golf shots, seek a club with an enlarged "sweet spot" (that area of the striking face that, upon striking the ball, will send the ball on a preferred trajectory, without "hooking" or "slicing"). In addition, modern golfers prefer a club head that is generally lightweight but with a significant portion of its weight behaving as if it were located behind the sweet spot. The hollow metal head of a metal wood offers the opportunity to engineer these desired features into the golf club.

A problem that occurs when one produces a hollow club head is that the flattened striking surface, which is supported around the edge thereof, acts much as a drum head when it is struck. The thin metal is free to deflect elastically upon impact and then rebound. The nature and direction of the rebound depends upon the location of the point of impact on the striking surface and can affect the speed, rotation, and direction of a golf ball as it leaves the club-head, thereby affecting the trajectory of the ball. Many inventors in the past have pointed to the desirability of having a totally inelastic, rigid striking surface on a golf club head. Some inventors have included in wooden golf club heads, rather thick metal inserts as the striking surface to produce a harder, more rigid contact surface. Others have even proposed glass and ceramic striking surfaces for club heads to achieve the same end. Of course, as in most all endeavors, there are nay-sayers who want to go in the other direction and have the striking surface capable of elastic deflection to offer more "spring" to the face, thereby (in their argument) to increase the rebound and make the ball go farther when it is struck. After testing various approaches, the applicant has decided in favor of the rigid, unyielding striking surface as the more desirable end product.

Many variations of metal woods have appeared on the market and in the patent literature. Applicant has seen none that offer the features of the present invention.

SUMMARY OF THE INVENTION

It is an object of this invention to provide a head for a metal wood that provides means for making more rigid the impact zone on the striking face of the club head.

It is an object of this invention to provide a head for a metal wood that provides means by which the force of an impact on the striking face of the club head is transferred to the rounded rear of the body of the club head.

It is an object of this invention to provide a head for such a metal wood whereby the means for transmitting the force of an impact on the striking face of the club head is rigid and substantially unyielding.

It is an object of this invention to provide a head for such a metal wood whereby a rigid, unyielding means for transmitting force includes a means for pre-stressing the transfer means.

It is an object of this invention to provide a head for such a metal wood whereby a rigid, unyielding means for transmitting force includes a means for compressively pre-stressing the transfer means.

It is an object of this invention to provide a head for such a metal wood whereby said means for compressively pre-stressing the transfer means includes a screw mechanism.

It is an object of this invention to provide a head for such a metal wood whereby said screw mechanism may be adjusted at the time of manufacture only.

It is an object of this invention to provide a head for such a metal wood whereby said screw mechanism is able to place a compressive force on the inside wall of the striking surface of the club head and a compressive force on the inside wall of the rounded rear surface of the club head.

These and other objects of this invention will become clear in the following description of the invention.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
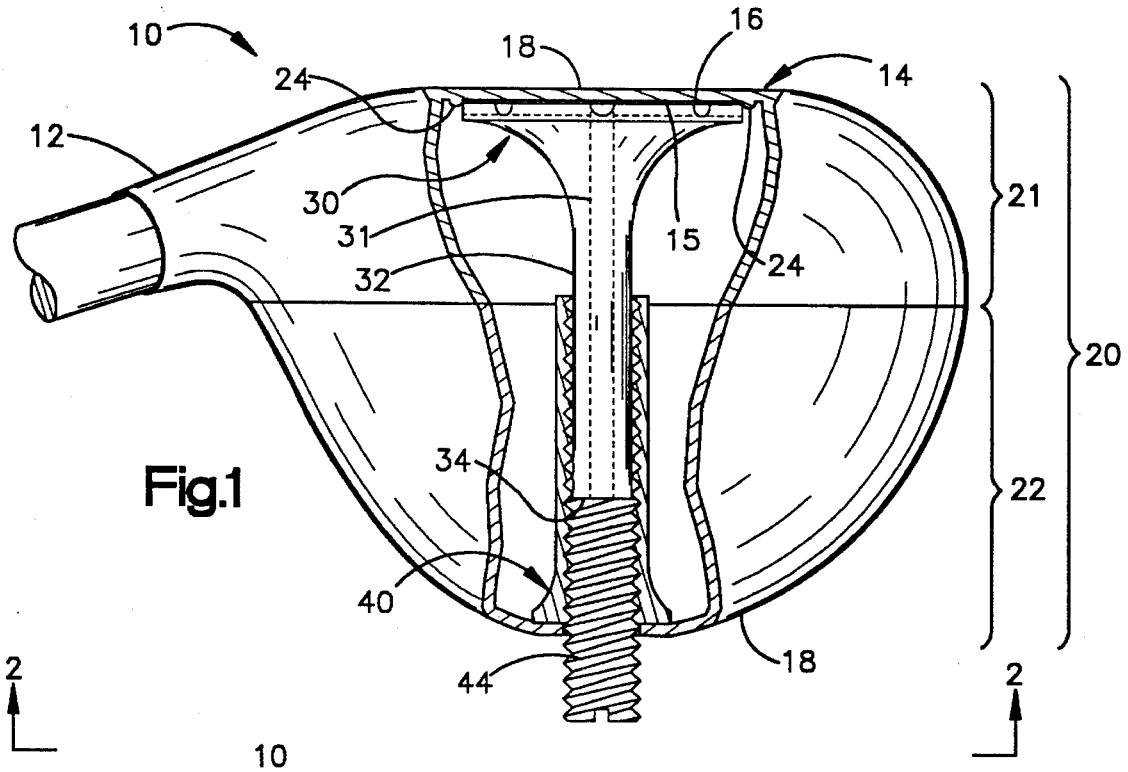
FIG. 1 shows a cutaway top view of a club head of this invention.

FIG. 1 shows a cutaway top view of a club head of this invention to make the essential features abundantly clear. The view is not truly vertical but is aligned with the plane of the backwardly slanting striking face 14. The club head 10 is adapted at 12 with a hosel to be fitted to an elongated shaft that is gripped by the player who uses the club of which the illustrated club head is only a part. The technology of fitting the head to the shaft and the details of the shaft are not a part of this invention.

The club head has a flattened, backwardly-slanted striking face 14 having an inside surface 15 and an outside surface 16 and a rounded rear surface 18 that are both a part of its bulbous body 20. The club head is a hollow body having a relatively thin continuous wall that, in practice is formed from two body pieces, a front piece 21 and a rear piece 22, which are joined as by welding or by other means, depending upon the material of which the body 20 is made. In common practice the body 20 is made of stainless steel, but other materials are possible, as has been mentioned.

For the practice of the present invention, the two-part club head body is an important feature for the assembling of the end product of the preferred mode. It will be seen that alternative assembly methods could be used for club heads that are not pieced together from two parts as is shown.

Figure 2:
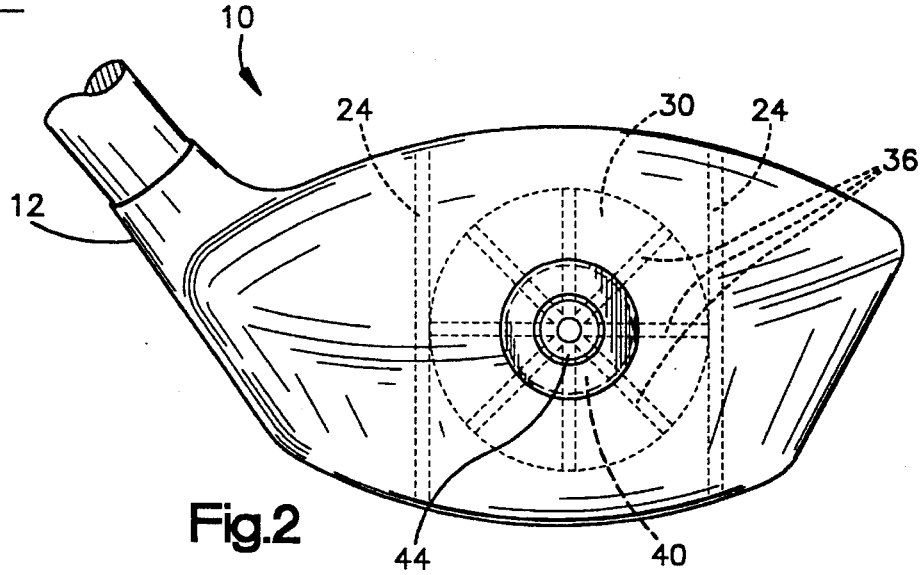
FIG. 2 shows a rear view of a club head of this invention.

FIG. 2 is a rear view of the club head shown in FIG. 1, with some of the internal parts shown in phantom.

Referring to FIG. 1 and 2, one can see evidence of vertical ribs 24 on the inside surface 15 of the striking face 14. These ribs are a common feature of many metal woods and serve to help stiffen the striking face 14. The ribs are not a part of the present invention, although they are present in the product of the best mode.

Figure 3:
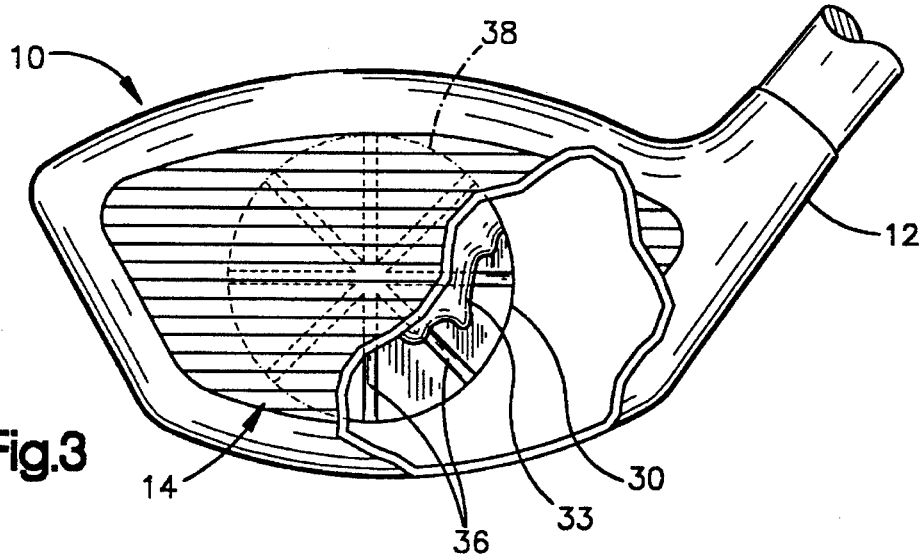
FIG. 3 shows a cutaway front view of a club head of this invention.

The backing plate 30 is a crucial element of the present invention. In the best mode the backing plate is trumpet-shaped as a means to put most of its mass directly behind the striking face of the club head while providing a tapered elongated stem for receiving and distributing an applied force. A passageway 31 through the length of the stem 32 of the backing plate of the best mode allows for the injecting of a cement or an epoxy resin 33 to the region of the face of the backing plate from the back end 34 of the stem 30, as best seen in FIG. 3. Channels 36, radiating from passageway 31, may be provided in the face of the backing plate to allow the spreading of such cement across the surface thereof. This cement, upon curing after assembly of the backing plate system, permanently bonds the inside surface of the striking face with the flat surface of the backing plate.

There is little doubt that merely affixing such a backing plate to the inside surface of the impact zone of a hollow metal wood offers substantial advantages over the same club head without such a backing plate. The backing plate affixed in this manner keeps the striking face flat, thereby all but eliminating the distortion caused by an impact upon the otherwise relatively thin, flat sheet of metal supported around the periphery thereof. Instead, the striking face having a backing plate behaves more like a rigid plate supported around the periphery. The latter, clearly produces a larger "sweet spot" 38 on the face of the club head than would otherwise be present. The presence of such a backing plate allows the metal skin that forms the shape of the club to be of reduced thickness, thereby the skin may be of lower weight and additional weight may be added to the backing plate, which appears to be a desirable goal. Additionally, a backing plate having a stem as herein described, places that additional weight behind the center of the impact zone, which is considered beneficial.

Surrounding a portion of the stem 32 of the backing plate 30 in the preferred mode shown in the drawings, is an elongated internally threaded belled tube 40 within which the stem 32 is axially slidably engaged. In practice, the backing plate 30 and the belled tube 40 are slidably assembled before the two parts of the club head body, front piece 21 and a rear piece 22, are joined. A jackscrew 44 is inserted through a hole at the back of the rear piece 22 and engages the threads of the internally-threaded belied tube 40 and is screwed in to engage the back of the stem of the backing plate 30. After such engagement, as the jackscrew is further screwed in, the backing plate is forced against the inside surface 15 of the striking face 14 and an equal and opposite force drives the belled tube 40 against the inside wall of the rear piece 22, placing the entire backing plate and belled tube system into compressive loading, to which we refer as a pre-stressed condition. This pre-stressing involves the skin of the club head as well as the backing plate, placing the skin in tension to balance the force being applied to the backing plate and belled tube system. The overall effect is to produce a club head that is more rigid than are those of metal woods of the prior art, especially in the reaction of the club to impact on the face thereof. The entire area of the club face that is backed by the backing plate is, in effect, "sweet spot" of the club.

In the practice of this invention, one would naturally take into account the practical aspects of a metal-to-metal joint and the irregularities that may be present in one or both surfaces that comprise that joint between the backing plate and the inner surface of the striking zone of the club head, the latter of which may be expected to have irregularities that cannot be readily machined smooth. It would be normal to insert at the joint a thickness of a softer material, such as lead, copper, or even cork or rubber to reduce the effect of such irregularities. Whereas it has been determined through inquiry to officials of the Professional Golf Association (PGA) that cork or rubber would not be acceptable under PGA rules in effect in 1994, these materials are avoided in the present invention. Any irregularities of the type described are accommodated by the injected cement that hardens to sufficient rigidity to be acceptable under the existing PGA rules.

Further in the assembly method, the jackscrew 44 is ground off flush with the skin of the club to produce a smooth exterior surface. The jackscrew, once installed and adjusted, is not subject to further adjustment.

Figure 4:
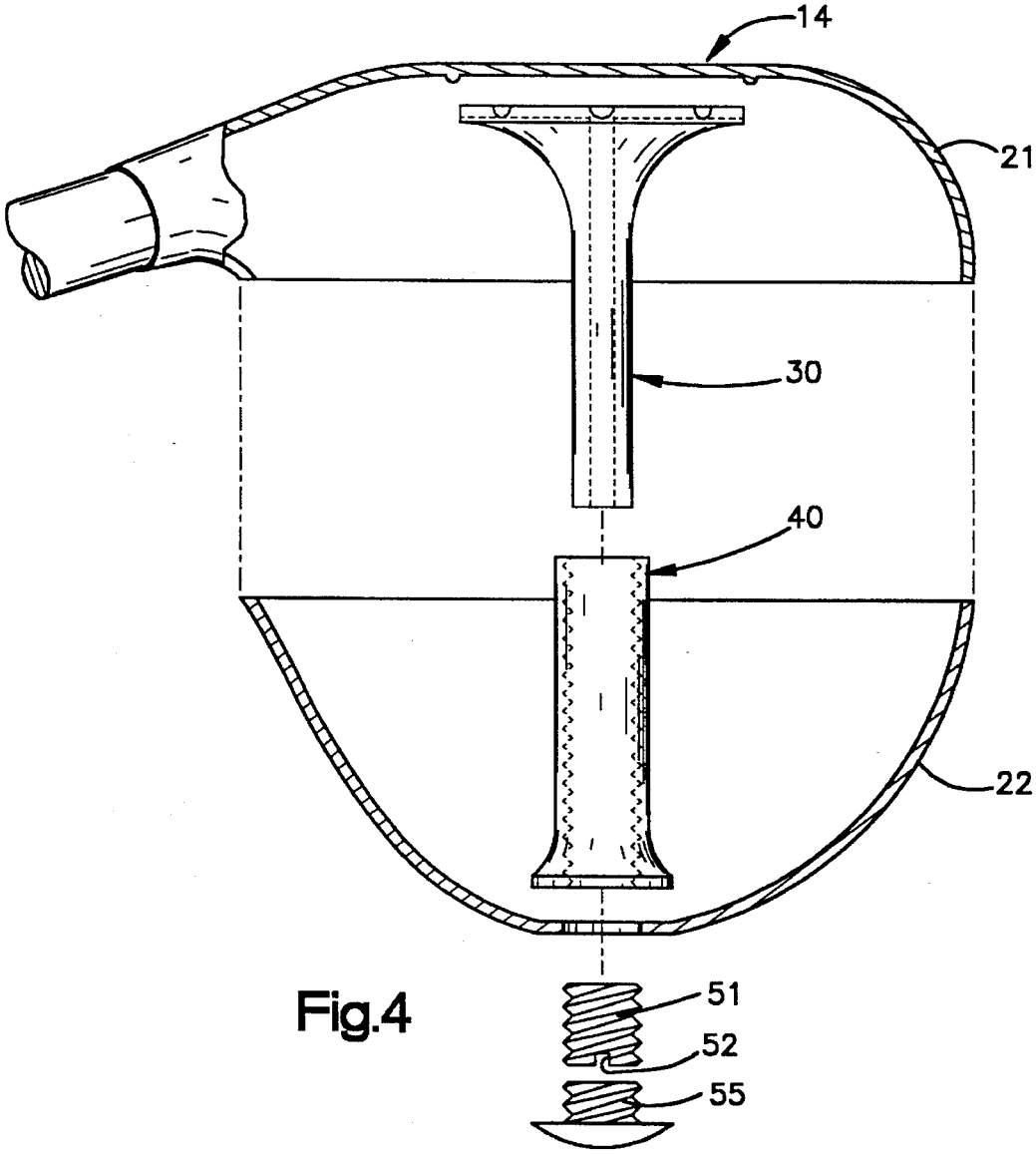
FIG. 4 shows cutaway exploded view of a club head of this invention.

FIG. 4 shows an exploded view of the invention and illustrates several variations of the invention related to weighting the club head. As an alternative to an elongated jackscrew, a headless set screw 51 having a length-to-diameter ratio of approximately 1:1 to 2:1, for example, and a recessed driver-engaging means 52 in the end thereof (a slot or a shaped hole for a Phillips head driver, an Allen wrench, or other shaped wrench, for examples) may be threaded into the belled tube to apply the compressive force to the backing plate. Such a set screw would leave a hole in the back surface of the club head that would then be filled or otherwise cosmetically covered to effect a smooth surface. A screw cover 55 is illustrated in FIG. 4. The set screw 51, once installed and adjusted, is not subject to further adjustment in the field. Removal of the cosmetic covering would expose the setscrew for readjusting the compressive force to the backing plate as may be desirable should the materials of construction suffer inelastic creep deformation over time. Rules of the PGA in effect in 1994 mandate that such readjustment not be made during play.

The pre-stressing of the backing plate 30 and its associated belled tube 40 provides a direct pre-stressed link between the impact zone of the club head and the skin at the rear of the club head. In analysis, the mechanical linking of these surfaces makes good sense; pre-stressing the link makes even better sense. In contrast to the flat face of the club head, which, even with a backing plate affixed to it, is subject to deflection upon impact with a golf ball, the curved shape of the rear of the club head is a more rigid structure from a simple engineering viewpoint. Whereas this curvature is intrinsically more rigid, it makes perfect sense to use it to support the intrinsically less rigid striking face of the club head, thereby to increase the apparent rigidity of the striking face. Pre-stressing this system adds to its rigidity.

Figure 5A:
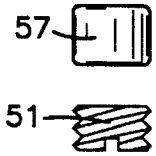
FIG. 5A shows one of several possible weighting systems that can be used.

It should also be abundantly clear that it may be desired to add additional weights behind the backing plate stem to provide yet more weight behind the impact zone of the club head. The cavity within the belled tube behind the stem of the backing plate can receive one or more weights 57 before the inserting of the screw that applies the pre-stressing forces, as shown in FIG. 5A. These weights must be of a material that is consistent with the pre-stressed condition if they are to be placed between the stem and the screw.

Figure 5B:
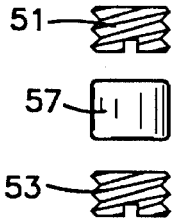
FIG. 5B shows another of several possible weighting systems that can be used.

An alternative placement of such added weights is between a set screw 51 that applies the desired pre-stressing forces directly to the backing plate stem, and a second set screw 53 that is provided merely to fix the position of the added weights. This is shown in FIG. 5B.

Figure 5C:
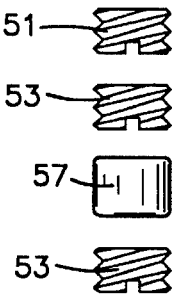
FIG. 5C shows another of several possible weighting systems that can be used.

A third alternative for placement of added weights allows the placement of weights in a position removed from the stem of the backing plate. In this case, a set screw 51 is used to pre-stress the backing plate and belled tube. After the set screw is adjusted, a second set screw-like screw 53 is positioned in the threaded hole in a position either touching the initial set screw or spaced away from it. Then weight 51 is added before a final set screw 53 is inserted to hold the weights in position, as shown in FIG. 5C. Thus, the axial positioning of the added weights is independent of the length of the stem or the degree of pre-stressing applied.

Figure 5D:
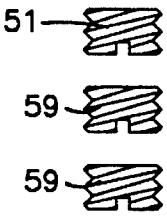
FIG. 5D shows another of several possible weighting systems that can be used.

Finally, as shown in FIG. 5D, added weights could be produced in the form of screws 59 made of lead or a heavy alloy, which could be positioned at any axial position within the threaded balled tube and between the pressure-applying setscrew 51 and the rear surface of the club head.

Figure 5E:
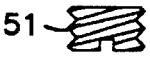
FIG. 5E shows yet another of several possible weighting systems that can be used.

The standard installation of the stress-applying setscrew is shown in FIG. 5E.

While I have shown and described only limited principal embodiments in accordance with the present invention, I do not wish to be limited to the details shown and described herein, but I intend to cover all such changes and modifications as are encompassed by the scope of the claims appended hereto.

I claim:

1. A hollow golf club head of the type known as a "metal wood" for playing the game of golf, said club head having a backwardly slanting striking face having an inner surface and an outer surface, and an opposing rear portion having an inner surface and an outer surface, a substantially flat-faced body having a stem portion having an axis protruding centrally from a rear thereof and substantially normal to the plane of said flat face, said face being rigidly bonded to said inner surface of said striking face, wherein said stem engages in an axially slidable manner the hollow of an open-ended, internally-threaded tube having a screw therein, said tube engaging said inner surface of said rear portion and said screw threadably engaging said tube and applying an axial compressive force to said stem and an equal and opposite axial compressive force to said tube, the magnitude of said compressive force may be adjusted by turning said screw.

2. The club head of claim 1 wherein said screw is inserted through a hole in said rear portion, said hole being in registry with the hollow of said threaded tube.

3. The club head of claim 2 wherein said screw fills said hollow within said tube not occupied by said stem portion and initially protrudes from said hole, but is trimmed off to be level with said outer surface of said rear portion after said compressive force is set by turning said screw.

4. The club head of claim 1 wherein said screw is configured for enabling it to be accessed and turned by means of a tool through a hole in said rear portion, said hole being in registry with the hollow of said threaded tube.

5. The club head of claim 4 wherein said screw has length-to-diameter ratio of approximately 1:1.

6. The club head of claim 1 wherein a weight to increase the weight of said club head is disposed within the hollow of said tube, thereby to position said weight in axial alignment with said stem portion of said backing plate.

7. The club head of claim 6 wherein said weight is placed between said screw and said stem portion.

8. The club head of claim 6 wherein said weight is disposed between said screw and a second screw that is present only to retain the weight.

9. The club head of claim 6 wherein said weight is disposed between two screws that are both present only to retain the weight.

10. The club head of claim 6 wherein said weight exists as a threaded screw engaging said threaded tube and that can be adjusted for axial position within said threaded tube by turning it about its axis within said tube.

11. A hollow golf club head of the type known as a "metal wood" for playing the game of golf, said club head having a backwardly slanting striking face having an inner surface and an outer surface, and an opposing rear portion having an inner surface and an outer surface, a substantially flat-faced rigid backing plate, the flat face of which is disposed against said inner surface of said striking face, and wherein said rigid backing plate further comprises a stem portion having an axis protruding centrally from the rear of said backing plate and substantially normal to the plane of said flat face, and wherein said stem engages in an axially slidable manner the hollow of an open-ended, internally-threaded tube having a screw therein, said tube engaging said inner surface of said rear portion and said screw threadably engaging said tube and applying an axial compressive force to said stem and an equal and opposite axial compressive force to said tube, the magnitude of said compressive force may be adjusted by turning said screw.

12. The club head of claim 11 wherein said screw is inserted through a hole in said rear portion, said hole being in registry with the hollow of said threaded tube.

13. The club head of claim 12 wherein said screw fills said hollow within said tube not occupied by said stem portion and initially protrudes from said hole, but is trimmed off to be level with said outer surface of said rear portion after said compressive force is set by turning said screw.

14. The club head of claim 11 wherein said screw is configured for enabling it to be accessed and turned by means of a tool through a hole in said rear portion, said hole being in registry with the hollow of said threaded tube.

15. The club head of claim 14 wherein said screw has length-to-diameter ratio of approximately 1:1.

16. The club head of claim 11 wherein a weight to increase the weight of said club head is disposed within the hollow of said tube, thereby to position said weight in axial alignment with said stem portion of said backing plate.

17. The club head of claim 16 wherein said weight is placed between said screw and said stem portion.

18. The club head of claim 16 wherein said weight is disposed between said screw and a second screw that is present only to retain the weight.

19. The club head of claim 16 wherein said weight is disposed between two screws that are both present only to retain the weight.

20. The club head of claim 16 wherein said weight exists as a threaded screw engaging said threaded tube and that can be adjusted for axial position within said threaded tube by turning it about its axis within said tube.

* * * * *